United States Patent [19]

McAfee

[11] Patent Number: 4,850,145

[45] Date of Patent: Jul. 25, 1989

[54] SLIDING DOOR FRAME AND CARRIAGE ASSEMBLY

[75] Inventor: Thomas H. McAfee, Seal Beach, Calif.

[73] Assignee: Charmac, Inc., Compton, Calif.

[21] Appl. No.: 247,682

[22] Filed: Sep. 22, 1988

[51] Int. Cl.[4] ..... E06B 3/00

[52] U.S. Cl. ..... 49/501; 49/404; 49/425

[58] Field of Search ..... 49/425, 404, 411, 501; 52/823, 475

[56] References Cited

U.S. PATENT DOCUMENTS

| | | | |
|---|---|---|---|
| 3,058,173 | 10/1962 | Brydolf | 20/19 |
| 3,261,129 | 7/1966 | Brydolf et al. | 49/411 |
| 3,450,426 | 6/1969 | Kellems | 287/189.35 |
| 3,562,956 | 2/1971 | Johnson, Jr. | 49/411 |
| 3,650,071 | 3/1972 | Tanner | 49/404 |
| 3,701,179 | 10/1972 | Cox | 16/90 |
| 3,744,827 | 7/1973 | Cox | 49/411 X |
| 3,750,337 | 8/1973 | Brydolf et al. | 49/409 |
| 4,123,874 | 11/1978 | Scott | 49/411 |
| 4,193,500 | 3/1980 | Scott | 49/425 X |

*Primary Examiner*—Philip C. Kannan

*Attorney, Agent, or Firm*—Fulwider, Patton, Rieber, Lee & Utecht

[57] ABSTRACT

A sliding door frame and carriage assembly which includes a pair of upper corner connectors to clamp together the upper corners of the frame. Such connectors also serve as upper guides or glides. The assembly also includes a pair of lower corner connectors which clamp together the lower frame corners and mount wheels for rolling support of the door. Each connector fits within adjacent slots in the rails and stiles to hold the connectors securely in position, and simultaneously clamp together the associated rails and stiles. Each connector is characterized by a rail connector spanning section which spans a portion of the outside wall of the associated rail to stabilize the connector in position and, in the case of the lower connectors, better distribute the weight of the door.

14 Claims, 2 Drawing Sheets

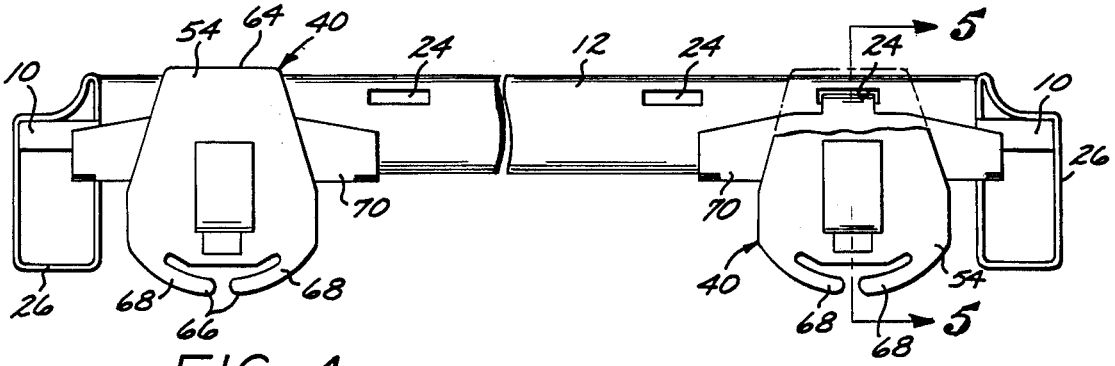
FIG. 4
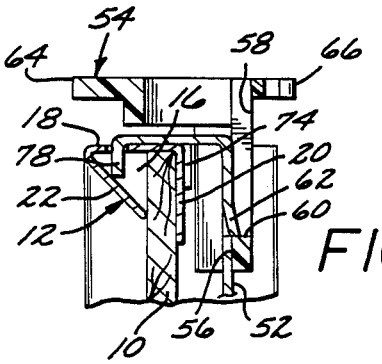
FIG. 5
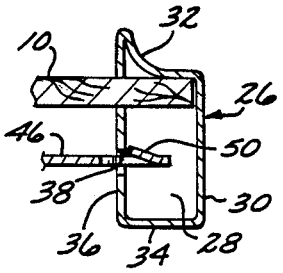
FIG. 6
FIG. 7
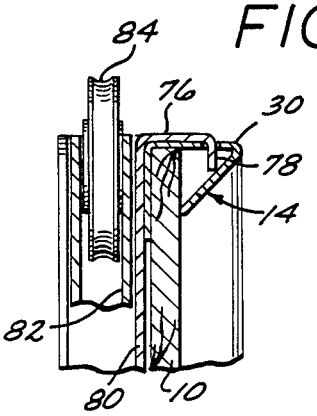
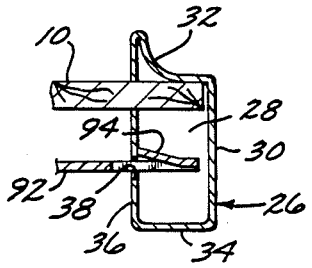
FIG. 8

SLIDING DOOR FRAME AND CARRIAGE ASSEMBLY

BACKGROUND OF THE INVENTION

1. Field of the Invention

The present invention relates to a sliding door frame and carriage assembly, and more particularly to such an assembly having corner connectors that also serve as door guides and supports.

2. Description of Prior Art

Cost is an important consideration in fabricating sliding wardrobe or closet doors for homes, apartments and the like. Such doors typically include a rectangular mirrored glass or decorative wood panel framed by horizontal upper and lower rails at the top and bottom, and by vertical stiles at the sides. The frame corners are clamped together by connectors, some of which also serve as guides or glides while others mount door supports. Of particular present interest are the sliding door designs in which the upper connectors act as the slides, which travel within an overhead guide track, and in which the lower connectors mount wheels for rolling support of the weight of the door.

The rails and stiles are each formed to include a central channel which receives an edge of the door panel. The rails and slides also include suitable slots or apertures to receive complemental elements of the corner connectors to hold them in position.

Each corner connector is preferably symmetrical so that identical upper connectors can be interchanged in position, and identical lower connectors can be similarly interchanged. The rails are also made identical to each other for interchangeability, as are the stiles. By thus eliminating right or left handed corner connectors, stiles and rails, the number of different door frame and carriage assembly components is greatly reduced, as are manufacturing costs and inventory and stocking problems.

If improperly done, simplication of connector corner designs, and minimization of the points of interconnection between the connectors and the rails and stiles can result in poorly fitting components, door twisting, inadequate door support, and loosening or dislodgement of the connectors during use.

U.S. Pat. No. 3,750,337 discloses symmetrical corner connectors adapted for rapid assembly with rails and stiles, but for adequate strength and stability the individual connectors are characterized by a relatively complex three point connection to the adjacent stiles. Portions of the connectors even engage the panel itself to achieve satisfactory rigidity.

Other prior art corner connectors achieve structural rigidity by using screw fasteners or the like for attachment to the rails and stiles. It is of course desirable to eliminate such fasteners and the attendant complexity and increased labor costs.

Certain prior art connectors perform satisfactorily in suspended door installation, but are inadequate to safely support the weight of the door in an installation in which the lower corner connectors mount supporting wheels adapted to roll along floor tracks.

Ideally, the corner connectors should be interengagable with the rails and stiles without any need for individual fasteners, and their construction should be simple and straightforward to minimize the cost of manufacture. The connectors should also be symmetrical to reduce the number of connectors required for each installation. Equally important, each connector, despite a minimum number of interengagement points with the rails and stiles, should be structurally rigid, provide good load distribution, and fit tightly enough that they do not become loosened or dislodged under rough usage.

SUMMARY OF THE INVENTION

The present sliding door frame and carriage assembly is characterized by identical upper and lower rails which are interconnected to identical vertical stiles by interchangeable upper corner connectors and by interchangeable lower corner connectors. The stiles include similarly located stile apertures at each end. Likewise, the rails include one or more similarly located rail apertures. The arrangement enables either the rails or the stiles to be reversed or turned end for end without affecting the assembly procedure.

Each corner connector includes a laterally extending clip which fits within the adjacent stile aperture. Each upper connector includes a tab which fits within one of the two rail apertures while each lower connector includes a pair of tabs which fit within a pair of rail apertures.

The connectors pull the rails and stiles together in tight fitting relation. Additional stability is achieved by a rail connector spanning section in each connector which spans a portion of the outside wall of the associated rail to constrain the connector against lateral tipping and, in the case of the lower connectors, better distribute the weight of the door.

Other aspects and advantages of the present invention will become apparent from the following more detailed description taken in conjunction with the accompanying drawings.

BRIEF DESCRIPTION OF THE DRAWINGS

FIG. 4 is a view taken along the line 4—4 of FIG. 2;

FIG. 5 is view taken along the line 5—5 of FIG. 4;

FIG. 6 is a enlarged view taken along the line 6—6 of FIG. 1;

FIG. 7 is a view taken along the line 7—7 of FIG. 3; and

FIG. 8 is an enlarged view taken along the line 8—8 of FIG. 1.

DESCRIPTION OF THE PREFERRED EMBODIMENTS

Figure 1:
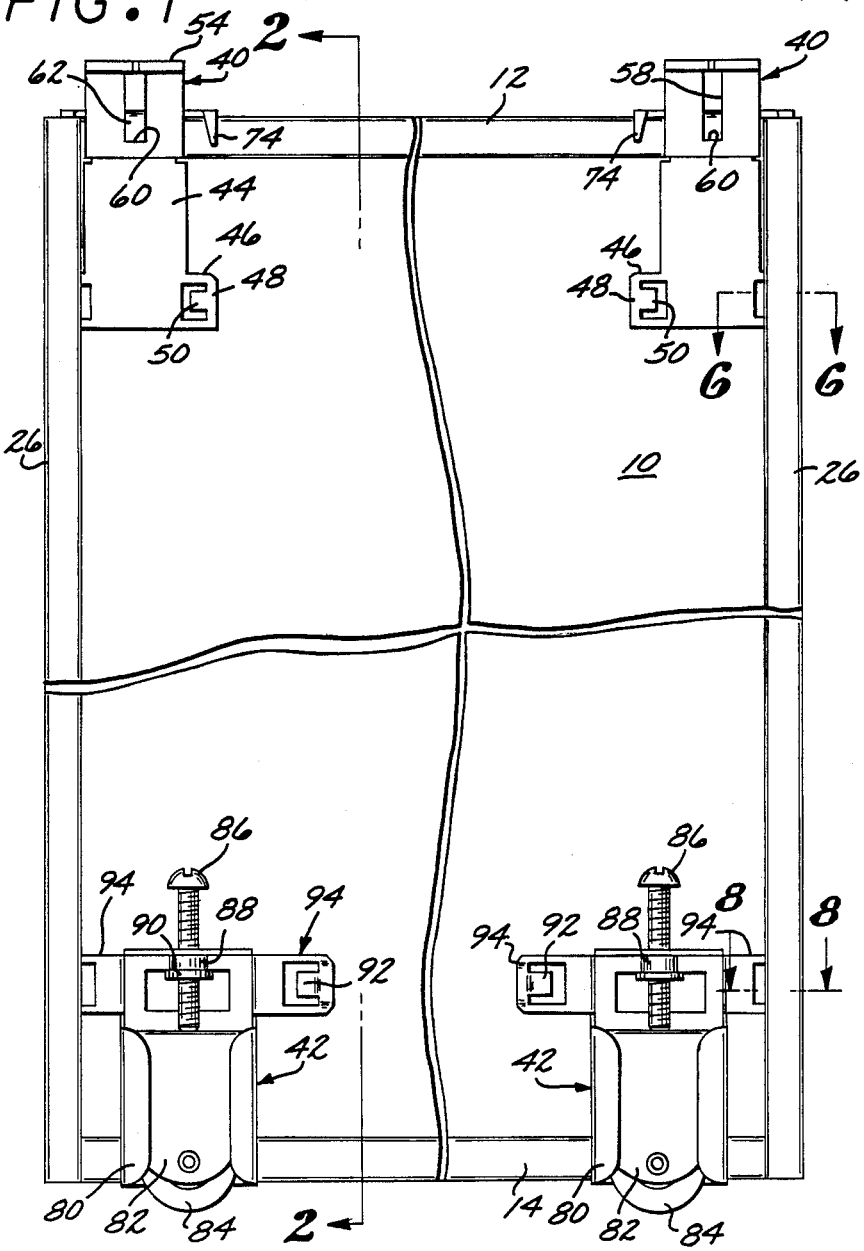
FIG. 1 is a rear elevational view of the present sliding door frame and carriage assembly, the length and width of the assembly being reduced to conserve drawing space.

The present sliding door frame and carriage assembly comprises a rectangular flat panel 10 made of mirrored glass, decorative plywood or the like. Upper and lower rails 12 and 14 are located adjacent the upper and lower edges of the panel.

Each rail is preferably sheet metal roll formed to define an internal hollow space or channel 16 which receives the adjacent edge of the panel 10. The channel 16 is defined by a horizontally oriented flat outside wall 18 in engagement with the edge of he panel, a rear wall 20 engaged upon the rear face of the panel, and a downwardly and inwardly inclined front wall 22 engaged upon the front face of the panel. The resilience of the sheet metal material and the spacing between the front and rear walls 22 and 20 resiliently holds the panel between the walls 20 and 22. Although not shown, the edges of the walls 20 and 22 are also preferably rolled to provide rounded edges to facilitate insertion of the panel.

The rails 12 and 14 are not coterminous with the panel edges. This is to leave enough space at the ends to accommodate the pair of vertical stiles, as will be seen.

The outside wall 18 at the extremities of each rail includes a pair of transversely elongated horizontal slots or rail apertures 24. The spacing between the apertures 24 and the spacing between the apertures and each rail end are the same in order to allow each rail to be flipped end for end, or interchanged with the other rail, and still cooperate properly with the associated vertical stiles and corner connectors, as will be seen.

A pair of vertically oriented stiles 26 are located adjacent the side edges of the panel 10. Each stile is preferably made of sheet metal roll formed to define an internal hollow space or channel 28 which receives the adjacent edge of the panel. The channel 28 is defined by a vertically oriented flat outside wall 30, a front wall 32 which is reversely formed at its extremity to provide a flange engaged upon the front face of the panel 10, and to provide a rear wall 34 extending inwardly to define an inside wall 36. The wall 36 extends forwardly, with its edge in engagement with the rear face of the panel 10. As was the case with the rails, the resilience of the sheet metal material of the stiles, and the spacing between the confronting edges of the front wall flange and the inside wall edge, resiliently hold the panel 10 firmly in position. Although not illustrated, the edges of the front wall 32 and inside wall 36 are also preferably rolled to provide rounded edges to facilitate insertion of the panel into the channel 28. Preferably the panel edge rests closely adjacent the inner surface of the outside wall 30, as seen in FIG. 8.

The extremity of each stile 26 includes a vertically elongated slot or stile aperture 38 which, as seen in a comparison of FIG. 1 and FIGS. 6 and 8, is located the same distance from the stile end as the other stile apertures. This permits the stiles to be reversed in position, or flipped end for end, and still be properly interengageable with the corner connectors.

The construction of the rails and stiles just described is relatively simple and inexpensive, involving only the roll forming of sheet metal and the punching or cutting of the rails and stiles to provide the rail and stile apertures.

The rails and stiles are interconnected at their corners to provide a rectangular frame around the panel 10. Such interconnection is provided by a pair of upper connectors and a pair of lower connectors.

The upper corners of the frame are clamped together by a pair of identical upper corner connectors 40 which also function as top guides or glides which slide within an overhead track (not shown). The lower two corners of the frame are clamped together by a pair of identical lower corner connectors 42 which mount wheel assemblies adapted to roll over a floor track (not shown) to support the weight of the door.

Each upper corner connector 40 is preferably stamped out of metal plate and includes a flat generally rectangular central section 44 having identical, oppositely directed anchoring clips 46 at its lower extremity for close receipt in the aperture.

Each clip includes a "D"-shape punched or cut out portion defining a laterally outwardly located post section 48 forwardly deformed at its central portion, and which includes an integral, laterally extending detent 50. The deformation of the post section 48 positions the detent 50 forwardly of the plane of the central section 44 to locate the detent 50 in position for resilient engagement with the inner forward margin of the stile aperture 38. This arrangement makes it possible to quickly mount the corner connector 40 to the adjacent stile by snapping the clip 46 into the stile aperture until the detent 50 is engaged upon the slot margin to maintain the connector in the mounted position. Disengagement of the detent is a simple matter when it is desired to remove the corner connector, as by insertion of a screwdriver or the like through the open end of the stile to press the detent 50 out of interfering engagement with the stile aperture margin.

As seen in FIG. 5, the upper extremity of the central section 44 is cut away at its side margins to define a narrower glide mount 52. A generally right angularly configured glide 54 includes a channel shape recess 56 in its vertical portion, which slidably fits over the glide mount 52.

The rear of the glide 54 includes a vertical slot 58 having a base margin 60. The glide mount 52 includes a rearwardly projecting detent 62 which is adapted on assembly to slide by the resiliently deformable plastic material of which the glide mount is made, finally resting upon the base margin 60 to constrain the glide against upward removal from the glide mount 52.

The right angular or horizontally oriented portion of the glide 54 is characterized by a forward face 64, as seen in FIGS. 4 and 5, and a rearward face 66. The rearward face 66 is formed by the rear surfaces of a pair of inwardly directed, confronting and spaced apart cantilever arms 68. The resilience of the plastic material of the glide is such that the cantilever arms 68 are in a forward direction upon engagement with a track guide surface or the like (not shown) to maintain good contact, the opposite or front face 64 being non-resiliently engaged with an opposite track surface (not shown).

The under surface of the horizontal or forwardly directed portion of the glide 54 rests upon the upper surface of a horizontally extending rail connector spanning section 70 integral with the corner connector glide mount 52.

The extremities of the section 70 are downwardly deformed to provide a pair of depending stabilizing elements 74. The outer one of the elements 74 extends into the hollow upper end of the adjacent vertical stile, while the other or inwardly located one of the stabilizing elements engages the rear face of the rail rear wall 20. The tabs 72 and the pair of elements 74 thus further stabilize the position of the upper corner connector 40. The action of these elements, together with that of the anchoring clip 46, firmly anchors the connector 40 in position, and also urges the adjacent stile and rail together to provide a good tight fit without unsightly gaps.

Figure 2:
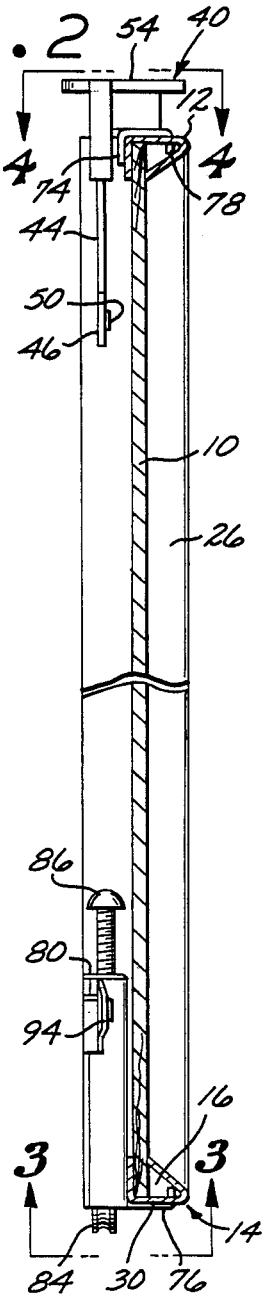
FIG. 2 is a view taken along the line 2—2 of FIG. 1.
Figure 3:
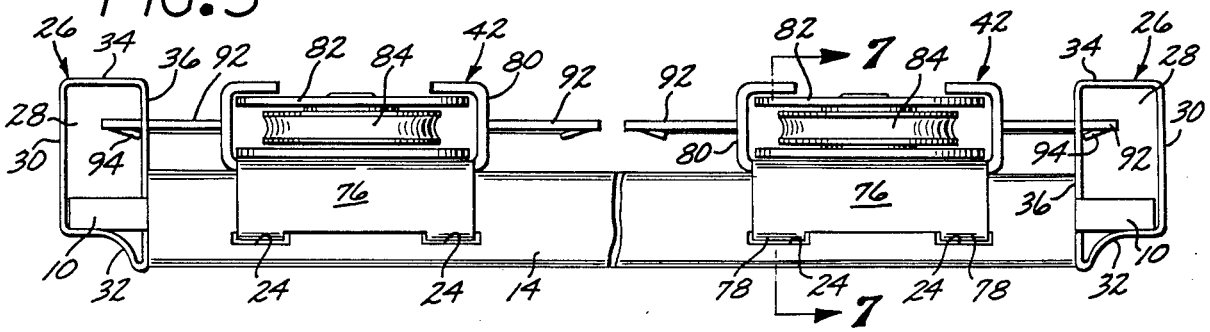
FIG. 3 is a view taken along the line 3—3 of FIG. 2.

Each lower corner connector 42 also includes a horizontally extending rail connector spanning section 76. As seen in FIG. 2, the section 76 extends over the flat rail outside wall 30 to stabilize the connector against tipping or rocking, and to better distribute the weight of the door, as will be seen.

The opposite extremities of the spanning section 76 include forwardly located, upwardly directed anchoring tabs 78 which extend into the associated pair of rail apertures 24 to further stabilize the connector in position.

The spanning section 76 is integral with a generally rectangular channel shape housing 80 which vertically slidably carries wheeled door support means in the form of a wheel mount 82 vertically slidable in the housing 80 and mounting a grooved wheel 84 for rolling engagement with a floor track (not shown) to support the weight of the door.

The vertical position of the wheel and wheel mount is adjusted by operation of an elongated adjustment screw 86 threaded through a nut 88 and bearing against the wheel mount 82 at its lower end. The nut 88 is trapped upon a rearwardly extending flange 90 integral with the housing 80, as seen in FIG. 1.

The housing 80 also includes a pair of integral, extending lateral clips 92 which are each configured to define a detent 94 like that of the upper connector clip. The clip 92 is adapted to fit closely within the adjacent stile aperture 38, the detent 94 resiliently deforming to pass into the aperture and thereafter springing outwardly to engage the forward edge margin of the stile aperture to prevent inadvertent withdrawal of the clip.

Other than the molded plastic wheels 84 and glide mounts 52, the corner connectors can be inexpensively blanked, stamped or punched, and bent from standard sheet stock. By reason of the symmetry of each connector, the parts for the upper and lower connectors can be made with only two sets of dies. Right and left handed parts are completely eliminated because of the reversability of the rails, stiles, upper corner connectors, and lower corner connectors.

Assembly of the door frame is an easy task, the rails being first positioned upon the upper and lower edges of the door panel, followed by positioning of the vertical stiles upon the side edges of the panel. Next, the upper corner connectors are fitted with the spanning sections 76 in position and, with a combined lateral-pivot action, the clips 46 are snapped into position within the stile apertures. Mounting of the lower corner connectors is similar, the spanning sections 76 seated in coordination with a lateral-pivot action of the upper portion of the connector to snap the clips 46 in position within the adjacent stile apertures. This arrangement tightly secures the connectors in position such that vibration, slamming of the door, and other hard usage are ineffective to loosen or dislodge the connectors. On the other hand, deliberate dismounting of the connectors is easily initiated by prying the detents loose with a screwdriver, as previously mentioned.

Various modifications and changes may be made with regard to the foregoing detailed description without departing from the spirit of the invention.

What is claimed is:

1. A sliding door frame and carriage assembly comprising:

a rectangular panel;

upper and lower rails located adjacent the upper and lower edges of the panel, each including wall means having an outside wall and defining a rail channel which receives the associated one of the panel upper and lower edges adjacent the outside wall, the outside wall at the extremities of each rail including a rail aperture spaced from the associated rail end the same distance as that of the other rail aperture;

a pair of stiles located adjacent the side edges of the panel, each including wall means having an inside wall and defining a stile channel which receives one of the panel side edges, the inside wall being engaged upon the rear of the panel, the inside wall at the extremities of each stile including a stile aperture spaced from the associated stile end the same distance as that of the other stile apertures;

a pair of upper corner connectors adjacent the upper panel corners, each including a horizontally extending rail connector spanning section engaged upon the upper rail outside wall and each having an anchoring tab extending into the rail aperture at the adjacent upper rail extremity, and each further including a laterally extending clip extending into the adjacent stile aperture, the clip including detent means engaging a margin of the stile aperture for preventing withdrawal of the clip; and a pair of lower corner connectors adjacent the lower panel corners, each including a horizontally extending rail connector spanning section engaged upon the lower rail outside wall and each including an anchoring tab extending into the adjacent rail aperture at the lower rail extremity, and each further including a laterally extending clip extending into the adjacent stile aperture, the clip including detent means engaging a margin of the stile aperture for preventing withdrawal of the clip.

2. A sliding door frame and carriage assembly according to claim 1 wherein the upper and lower corner connectors each also include an oppositely extending clip whereby each of such connectors is symmetrical and thereby adapted for connection to either of the stiles.

3. A sliding door frame and carriage assembly according to claim 1 wherein the upper corner connectors constitute top glides and the lower corner connectors constitute wheeled door support means.

4. A sliding door frame and carriage assembly comprising:

a rectangular panel;

upper and lower rails located adjacent the upper and lower edges of the panel, each including wall means having an outside wall and defining a rail channel which receives the associated one of the panel upper and lower edges adjacent the outside wall, the outside wall at the extremities of each rail including a pair of rail apertures spaced apart the same distance, and spaced from the associated rail end the same distance as that of the other pairs of rail apertures;

a pair of stiles located adjacent the side edges of the panel, each including wall means having an inside wall and defining a stile channel which receives one of the panel side edges, the inside wall being engaged upon the rear of the panel, the inside wall at the extremities of each stile including a stile aperture spaced from the associated stile end the same distance as that of the other stile apertures;

a pair of upper corner connectors adjacent the upper panel corners, each including a horizontally extending rail connector spanning section engaged upon the upper rail outside wall and each having an anchoring tab extending into one of the rail apertures in the adjacent upper rail extremity, and each further including a laterally extending clip extending into the adjacent stile aperture, the clip including detent means engaging a margin of the stile aperture for preventing withdrawal of the clip; and a pair of lower corner connectors adjacent the lower panel corners, each including a horizontally extending rail connector spanning section engaged upon the lower rail outside wall and each including a pair of horizontally spaced apart anchoring tabs extending into the adjacent pair of the rail apertures at the lower rail extremity, and each further including a laterally extending clip extending into the adjacent stile aperture, the clip including detent means engaging a margin of the stile aperture for preventing withdrawal of the clip.

5. A sliding door frame and carriage assembly according to claim 4 wherein each upper connector anchoring tab extends into the laterally outward one of the associated pair of rail apertures.

6. A sliding door frame and carriage assembly according to claim 4 wherein the upper and lower corner connectors each also include an oppositely extending clip whereby each of such connectors is symmetrical and thereby adapted for connection to either of the stiles.

7. A sliding door frame and carriage assembly according to claim 4 wherein the upper corner connectors constitute top glides and the lower corner connectors constitute wheeled door support means.

8. A sliding door frame and carriage assembly according to claim 4 wherein each rail connector spanning section of each upper corner connector further includes a pair of depending stabilizing elements located on opposite sides of the upper connector anchoring tab and engaging the back face of the upper rail.

9. A sliding door frame and carriage assembly according to claim 4 wherein each lower corner connector includes a front surface engaged upon the rear surface of the panel.

10. A sliding door frame and carriage assembly according to claim 4 wherein the upper corner connectors each constitute a top glide having a front glide surface and a pair of inwardly directed, confronting and spaced apart resilient cantilever arms defining forwardly deflectable rear guide surfaces.

11. A sliding door frame and carriage assembling comprising:

a rectangular panel;

upper and lower rails located adjacent the upper and lower edges of the panel, each including wall means having an outside wall and defining a rail channel which receives the associated one of the panel upper and lower edges adjacent the outside wall, the outside wall at the extremities of each rail including a pair of rail apertures spaced apart the same distance, and spaced from the associated rail end the same distance as that of the other pairs of rail apertures;

a pair of stiles located adjacent the side edges of the panel, each including wall means having an inside wall and defining a stile channel which receives one of the panel side edges, the inside wall being engaged upon the rear of the panel, the inside wall at the extremities of each stile including a stile aperture spaced from the associated stile end the same distance as that of the other stile apertures;

a pair of upper corner connectors adjacent the upper panel corners and constituting top glides, each including a horizontally extending rail connector spanning section engaged upon the upper rail outside wall and each having an anchoring tab extending into the laterally outward one of the rail apertures at the upper rail extremity, and each further including a pair of laterally extending clips, one of which extends into the adjacent stile aperture, each clip including detent means engaging a margin of the stile aperture for preventing withdrawal of the clip; and a pair of lower corner connectors adjacent the lower panel corners and constituting wheeled door support means, each including a horizontally extending rail connector spanning section engaged upon the lower rail outside wall and each including a pair of horizontally spaced apart anchoring tabs extending into the adjacent pair of the rail apertures at the lower rail extremity, and each further including a pair of laterally extending clips, one of which extends into the adjacent stile aperture, the clip including detent means engaging a margin of the stile aperture for preventing withdrawal of the clip.

12. A sliding door frame and carriage assembly according to claim 11 wherein each rail connector spanning section of each upper corner connector further includes a pair of depending stabilizing elements located on opposite sides of the upper connector anchoring tab and engaging the back face of the upper rail.

13. A sliding door frame and carriage assembly according to claim 11 wherein each lower corner connector includes a front surface engaged upon the rear surface of the panel.

14. A sliding door frame and carriage assembly according to claim 11 wherein each top glide includes a front glide surface and a pair of inwardly directed, confronting and spaced apart resilient cantilever arms defining forwardly deflectable rear guide surfaces.

* * * * *